US007295985B2

(12) United States Patent
Kawashima et al.

(10) Patent No.: US 7,295,985 B2
(45) Date of Patent: Nov. 13, 2007

(54) MUSIC DATA COMPRESSION METHOD AND PROGRAM FOR EXECUTING THE SAME

(75) Inventors: Takahiro Kawashima, Hamakita (JP); Nobukazu Toba, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 932 days.

(21) Appl. No.: 10/392,236

(22) Filed: Mar. 19, 2003

(65) Prior Publication Data

US 2003/0182133 A1 Sep. 25, 2003

(30) Foreign Application Priority Data

Mar. 20, 2002 (JP) ..... 2002-078264

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS 5,869,782 A * 2/1999 Shishido et al. ..... 84/609

* cited by examiner

*Primary Examiner*—David Hudspeth
*Assistant Examiner*—Jakieda R. Jackson
(74) *Attorney, Agent, or Firm*—Pillsbury Winthrop Shaw Pittman LLP

(57) ABSTRACT

There is provided a novel music data compression method which is capable of significantly reducing the size of music data. Music data including a sequence of performance event data each formed of note information is received. Each of the pieces of performance event information of the music data is converted to another form of performance event information including status information corresponding to a matching or mismatching pattern in note information between the piece of performance event information and an immediately preceding one of the pieces of performance event information, and note information necessitated according to the matching or mismatching pattern to which the status information corresponds.

10 Claims, 10 Drawing Sheets

MUSIC DATA COMPRESSION METHOD AND PROGRAM FOR EXECUTING THE SAME

BACKGROUND OF THE INVENTION

1. Field of the Invention

The present invention relates to a music data compression method of compressing performance event information formed of note information, such as information of a tone pitch, sounding timing, sounding duration, and a channel number corresponding to a part, and more particularly to a music data compression method suitable e.g. for distribution of music data, such as an incoming call melody for a cellular phone.

2. Description of the Related Art

In recent years, the use of networks by electronic devices or apparatuses (terminal devices), such as cellular phones and personal computers, has been rapidly expanding, and it has become possible to receive services of various data contents from servers via such terminal devices. An example of the data contents includes music data to be sounded as an incoming call melody through a cellular phone, and music data of a music piece or karaoke music played through a personal computer.

However, as the reproduction time and/or the number of parts of such a music piece increases, the data size also increases, which causes an increase in communication time and costs necessary for downloading music data of an incoming call melody or the like. Further, a terminal device necessitates a large memory capacity for storing the music data in the device. To overcome these problems, it is demanded to compress music data.

Japanese Laid-Open Patent Publication (Kokai) No. 8-22281 discloses a method of compressing MIDI signals by analyzing MIDI signals as music data to detect a tone or a pattern which continuously occurs repeatedly, deleting a portion of the music data corresponding to the detected repeatedly occurring tone or pattern, and inserting into the music data a signal indicative of the tone or pattern being to continuously occur repeatedly in place of the deleted portion. Another method is disclosed in Japanese Laid-Open Patent Publication (Kokai) No. 9-153819, which employs a data-rearranging process in which MIDI data (composed of five data elements of tone pitch, duration, tone length, velocity, and channel number) of each tone is decomposed into the five data elements, and then pieces of data of each of the five data elements are recombined into a group of data of the data element, to thereby increase the compression ratio of a reversible (lossless) compressor in a subsequent stage.

According to the method proposed by Japanese Laid-Open Patent Publication (Kokai) No. 8-22281, however, e.g. when considering key-on events, in MIDI data, which is comprised of status information formed of information indicative of a key-on event and information indicative of a channel, key number information (7 bits), velocity information (7 bits), and gate time information (and duration information in some cases), tones identical in all these kinds of information rarely occur in succession, resulting in a low compression efficiency. Further, although a high compression ratio can be expected for compression of a type of music data containing repeated occurrences of a predetermined pattern or passage, this requires the use of a complicated algorithm for detecting long repetitive sections.

On the other hand, the technique proposed by Japanese Laid-Open Patent Publication (Kokai) No. 9-153819 is used for compressing karaoke contents in a communication karaoke system. According to this technique, karaoke contents subjected to the data-rearranging process are once downloaded into a terminal device installed in a karaoke room or at home, and then the respective groups of the five data elements are again rearranged into the original MIDI data of each tone, to be used as karaoke data. Therefore, this technique is not suitable for stream reproduction in which reproduction of music data is performed while receiving the data from a server via a network. Further, this Japanese Laid-Open Patent Publication (Kokai) No. 9-153819 only discloses rearranging elements of data, but does not propose any novel compression method.

SUMMARY OF THE INVENTION

It is an object of the present invention to provide a novel music data compression method which is capable of largely reducing the size of music data, and a program for executing the method.

To attain the above object, in a first aspect of the present invention, there is provided a music data compression method comprising the steps of receiving music data including a sequence of pieces of performance event information each formed of note information, and converting each of the pieces of performance event information of the music data to another form of performance event information including status information corresponding to a matching or mismatching pattern in note information between the piece of performance event information and an immediately preceding one of the pieces of performance event information, and note information necessitated according to the matching or mismatching pattern to which the status information corresponds.

With the method according to the first aspect of the present invention, since each of the pieces of performance event information of the music data is converted to another form of performance event information including status information corresponding to a matching or mismatching pattern in note information between the piece of performance event information and an immediately preceding one of the pieces of performance event information, and note information necessitated according to the matching or mismatching pattern to which the status information corresponds, the other form of performance event information contains only mismatching note information other than matching note information, compared with the immediately preceding piece of performance event information, which makes it possible to reduce the data size of the music data. In expanding the compressed music data, the compressed performance event information can be expanded to its original form before compression, based on a matching or mismatching pattern indicated by the status information thereof, by referring to the note information of the immediately preceding piece of performance event information, if necessary.

Preferably, the note information includes tone pitch information, and the conversion step includes representing the tone pitch information included in the note information by a difference from a predetermined initial tone pitch.

According to this preferred form, the tone pitch information (difference) after the compression is a relative value to the initial tone pitch, and hence it is possible to make the data size of the music data smaller than when the tone pitch is represented by the absolute value thereof for the whole note range.

More preferably, the initial tone pitch is tone pitch of any one of the pieces of performance event information included in the music data.

Since the initial tone pitch can be thus set to the tone pitch of the first tone of the music data, the tone pitch of a desired tone of the music data, or an intermediate tone pitch between the highest tone and the lowest tone of the music data, it is possible to make the data size of the music data still smaller.

More preferably, the music data received in the receiving step comprises a sequence of pieces of performance event information for a plurality of channels, and the conversion step includes arranging the pieces of performance event information for all the plurality of channels in a time series order, and detecting a match or a mismatch in note information between each of the pieces of performance event information arranged for all the plurality of channels in a time series order and an immediately preceding one of the pieces of performance event information.

With the more preferable method according to the first aspect, since the music data is thus compressed based on detection of a match or a mismatch in note information between each of the pieces of performance event information arranged for all the plurality of channels in a time series order and an immediately preceding one of the pieces of performance event information, the compressed music data also contains pieces of performance event information arranged for all the plurality of channels in a time series order. As a result, for example, when the compressed music data is distributed, it is possible to reproduce musical tones from the music data while receiving the same (i.e. to perform stream reproduction).

Alternatively, in the method according to the first aspect, the music data received in the receiving step comprises a sequence of pieces of performance event information for a plurality of channels, and the conversion step includes arranging the pieces of performance event information in a time series order on a channel-by-channel basis, and detecting a match or a mismatch in note information between each of the pieces of performance event information arranged in a time series order on a channel-by-channel basis and an immediately preceding one of the pieces of performance event information.

Since music data is thus compressed based on detection of a match or a mismatch in note information between each of the pieces of performance event information arranged in a time series order on a channel-by-channel basis and an immediately preceding one of the pieces of performance event information, each of the pieces of performance event information contained in the music data on a channel-by-channel basis need not contain channel information, which contributes to reduction of the data size of the music data.

More preferably, the initial tone pitch is set for each of the plurality of channels, and the tone pitch information is represented by the difference for each of the plurality of channels.

According to this preferred form, even if the music data contains a piece of tone pitch information which cannot be represented by a predetermined data length in the case of the note pitch information is expressed by the difference from a single initial tone pitch for all the channels, the initial tone pitch is set for each of the plurality of channels, and as a result, there is an increased probability that such note information can be represented by the difference from the initial tone pitch set for the corresponding channel, which enables further reduction of the data size of the music data.

More preferably, the initial tone pitch comprises a single tone pitch, and the tone pitch information of each of the pieces of performance event information for all plurality of channels arranged in a time series order is represented by the difference from the single initial tone pitch.

Since the initial tone pitch comprises a single tone pitch, the compression processing can be simplified.

More preferably, the note information of each of the pieces of performance event information contains interval information indicative of an interval from an immediately preceding one of the pieces of performance event information and information of sounding duration of a performance event related to the piece of performance event information, and the conversion step includes representing the interval information and the information of sounding duration by a predetermined note length.

Since the interval information and the information of sounding duration are thus represented by, or approximated to, the predetermined note length corresponding thereto, it is possible to reduce the data size of the music data.

To attain the above object, in a second aspect of the present invention, there is provided a program for causing a computer to execute a music data compression method, comprising a receiving module for receiving music data including a sequence of pieces of performance event information each formed of note information, and a conversion module for converting each of the pieces of performance event information of the music data to another form of performance event information including status information corresponding to a matching or mismatching pattern in note information between the performance event information and an immediately preceding one of the pieces of performance event information, and note information necessitated according to the matching or mismatching pattern to which the status information corresponds.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 4:
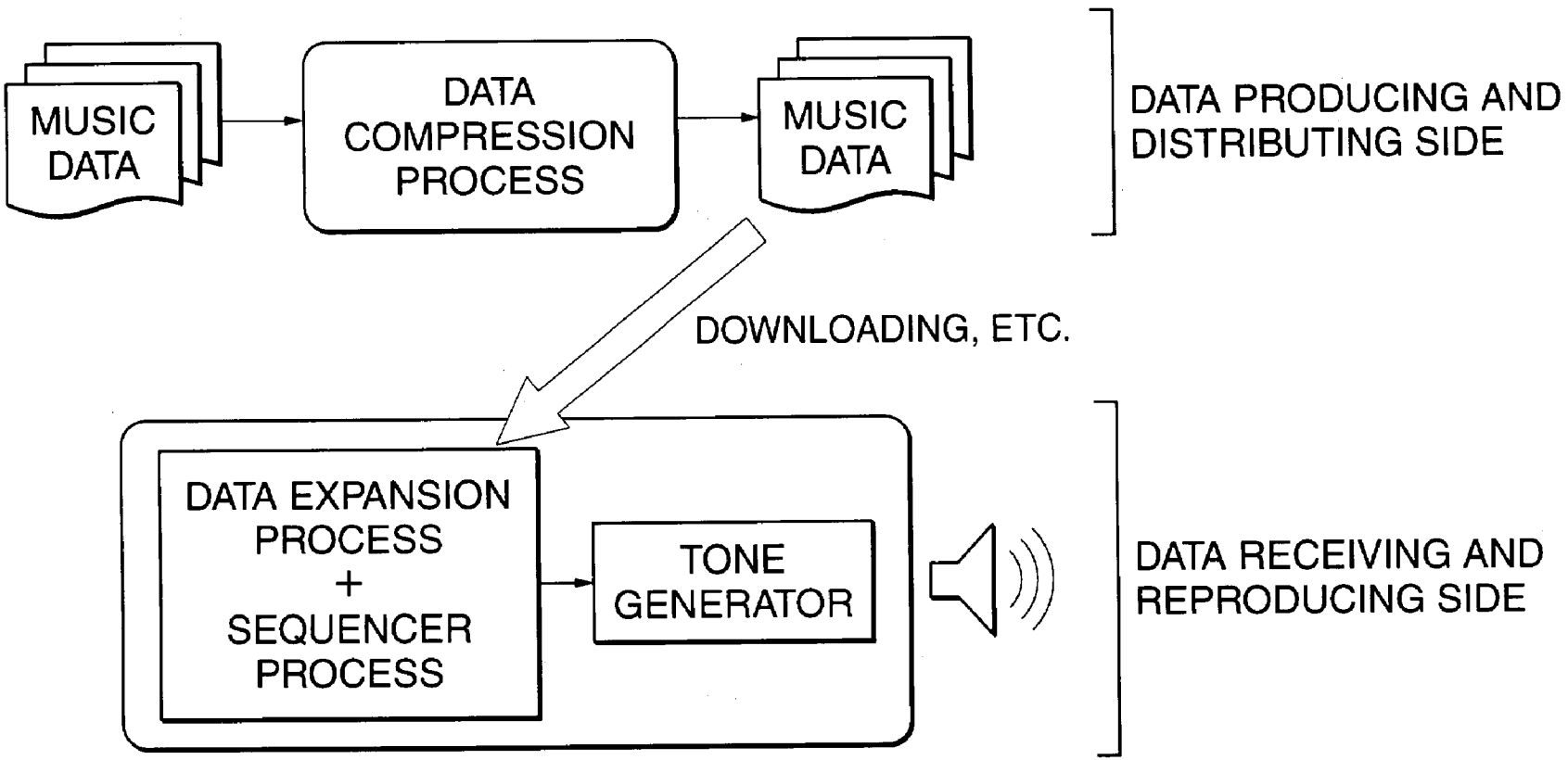
FIG. 4 is a diagram showing the basic configuration of a system to which is applied the music data compression method according to the embodiment.

Referring first to FIG. 4, there is shown the basic configuration of a system to which is applied a music data compression method according to an embodiment of the present invention. As shown in FIG. 4, a data producing and distributing side, such as a distribution server (computer), compresses music data in the standard MIDI file (SMF) format, or music data in a format employed by the present embodiment (SMAF format), into compressed music data in a format specific to the present embodiment.

A data receiving and reproducing side, such as a cellular phone, downloads the music data compressed on the data producing and distributing side, to store the same in a memory on the data receiving and reproducing side. During reproduction of the music data, the cellular phone or the like as the data receiving and reproducing side expands the music data stored in the memory and carries out sequencer processing to deliver key-on data, note number data, key-off data, etc. to predetermined channels of a tone generator for sounding the music data. It should be noted that in the following description, the data producing and distributing side is referred to as "the distribution server", the data receiving and reproducing side as "the cellular phone", and music data as "incoming call melody data".

Figure 5:
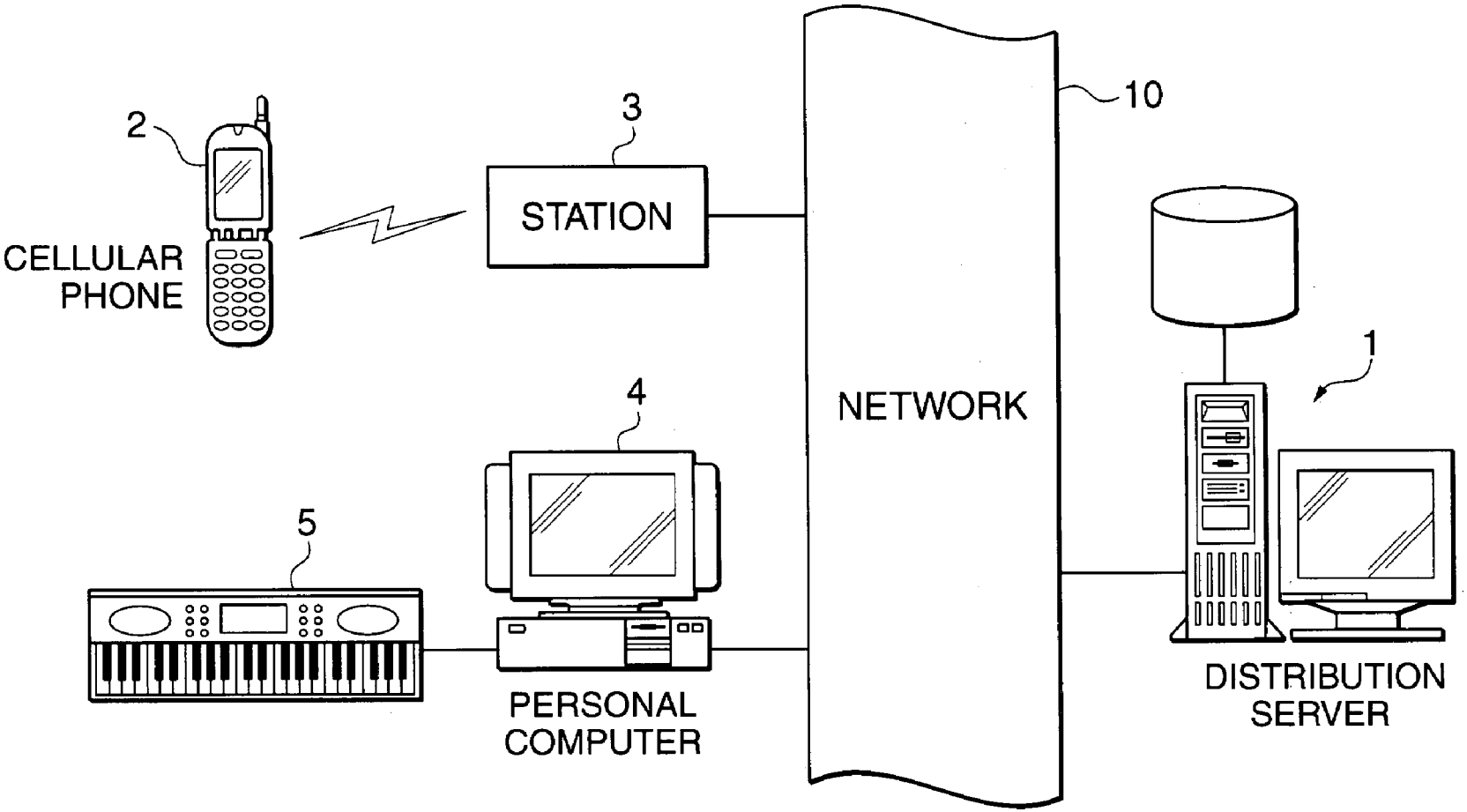
FIG. 5 illustrates a specific example of the configuration of the FIG. 4 system.

FIG. 5 illustrates an example of the configuration of the FIG. 4 system. In FIG. 5, connected to a network 10, which is a telephone exchange network, the Internet, or the like, are a distribution server 1 for distributing incoming call melody data, a station 3 to which a user's cellular phone 2 is connected by wireless, and a personal computer 4 compatible with the network.

Figure 6:
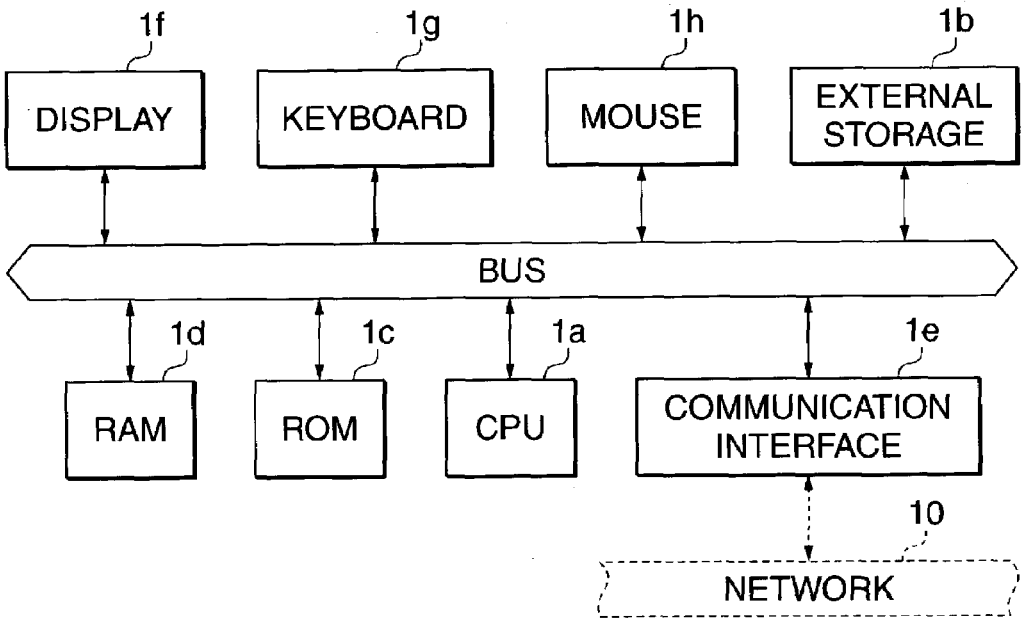
FIG. 6 is a block diagram showing the hardware configuration of a computer provided in a distribution server appearing in FIG. 5.

FIG. 6 is a block diagram showing the hardware configuration of the computer provided in the distribution server 1 appearing in FIG. 5. As shown in FIG. 6, a CPU 1*a* operates on an OS installed in an external storage 1*b* to execute various processes by using a ROM 1*c* and a RAM 1*d*. The external storage 1*b* is implemented e.g. by a large-capacity HDD (Hard Disk Drive) and stores various kinds of data, such as various music data in the SMF format and the SMAF format, various kinds of information (sources of a plurality of WWW pages formed by HTML), and so forth. Further, a communication interface 1*e* is connected to the network 10, and the distribution server 1 provides services for distributing music data of incoming call melodies to the user's cellular phone 2 and the like. In distributing the music data, the CPU 1*a* carries out compression processing for compressing the music data, communication processing, and so forth, as described in detail hereinafter. The distribution server 1 further includes a display 1*f*, a keyboard 1*g*, and a mouse 1*h*, as input/output devices for an operator.

Figure 7:
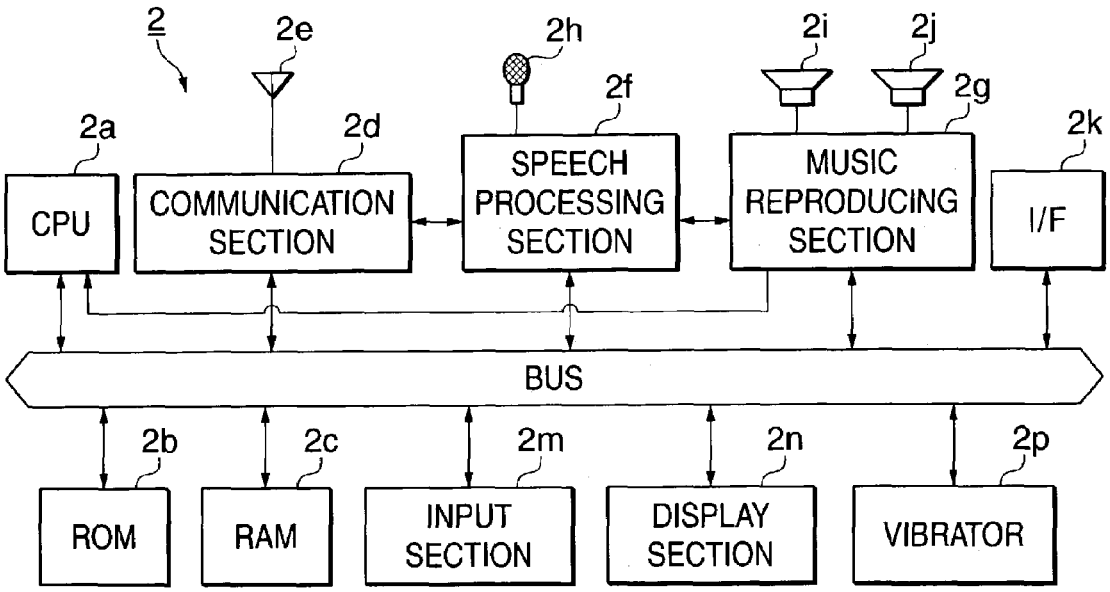
FIG. 7 is a block diagram showing the hardware configuration of a cellular phone appearing in FIG. 5.

FIG. 7 is a block diagram showing the hardware configuration of the cellular phone 2 appearing in FIG. 5. As shown in FIG. 7, a CPU 2*a* controls the overall operation of the cellular phone 2 by executing programs stored in a ROM 2*b*. A RAM 2*c* is used as a work area for the CPU 2*a*, a storage area for storing music data downloaded by the distribution service, and a storage area for storing configuration data set by the user. A communication section 2*d* demodulates signals received by an antenna 2*e*, and modulates signals for transmission to supply the demodulated signals to the antenna 2*e*. A speech processing section 2*f* decodes received speech signals demodulated by the communication section 2*d*, and a music reproducing section 2*g* outputs the decoded received speech signals through a received speech speaker 2*i* as sound. Further, the music reproducing section 2*g* reproduces musical tones from music data of an incoming call melody and then outputs the musical tones of the incoming call melody through an incoming call speaker 2*j*. A speech signal input via a microphone 2*h* is compressed and encoded by the speech processing section 2*f*, and the encoded speech signal is transmitted by the communication section 2*d*.

An interface (I/F) 2*k* is for downloading music data, tone color data, etc., from an external device or apparatus, such as a personal computer. The cellular phone 2 includes an input section 2*m* comprised of dial buttons and various kinds of operation elements, a display section 2*n* for performing predetermined displays according to operations for selecting distribution services and operations of the dial buttons and the like, a vibrator 2*p* for causing vibration of the main body of the cellular phone instead of generating an incoming call sound when a phone call is received.

The music reproducing section 2*g* reproduces a music piece by reading out performance event data from a music data buffer provided in the section 2*g*. When an empty or available area of a predetermined size is produced in the music data buffer during reproduction of the music piece, an interruption request signal is delivered to the CPU 2*a*. Responsive to the request signal, the CPU 2*a* reads out music data that is to follow the music data remaining in the music data buffer, from the compressed music data stored in the RAM 2*c*, and transfers the music data read from the RAM 2*c* to the music reproducing section 2*g*. Before being supplied to the music reproducing section 2*g*, the music data is expanded by the CPU 2*a*. Timing for executing the expansion depends on the formats referred to hereinbelow. It should be noted that the music reproducing section 2*g* includes a tone generator that generates musical tone signals for a plurality of sounding channels by time division multiplexing, and reproduces an incoming call melody in accordance with performance events in music data, in the same manner as in reproduction of musical tones for automatic performance. The technique of reproducing musical tones for automatic performance based on music data is well known, and hence detailed description thereof is omitted.

Figure 3A:
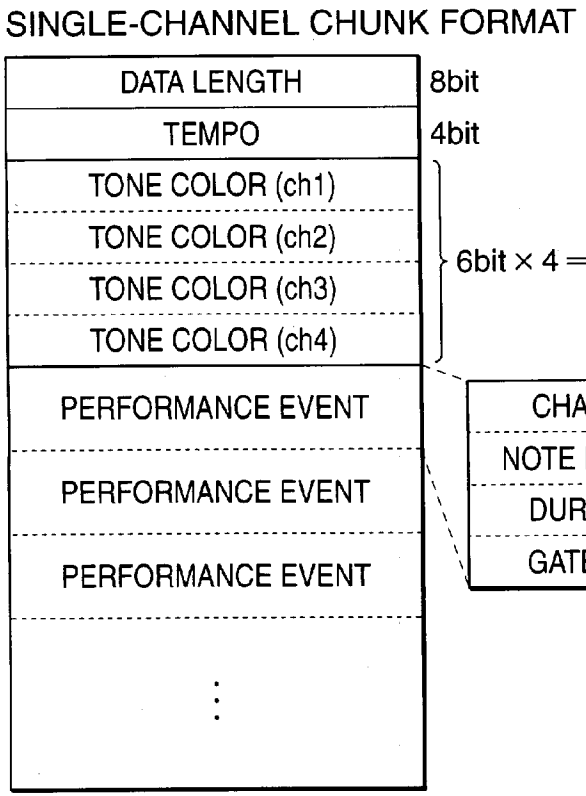
FIGS. 3A and 3B are diagrams showing two types of formats of music data to be compressed by the music data compression method according to the embodiment.
Figure 3B:
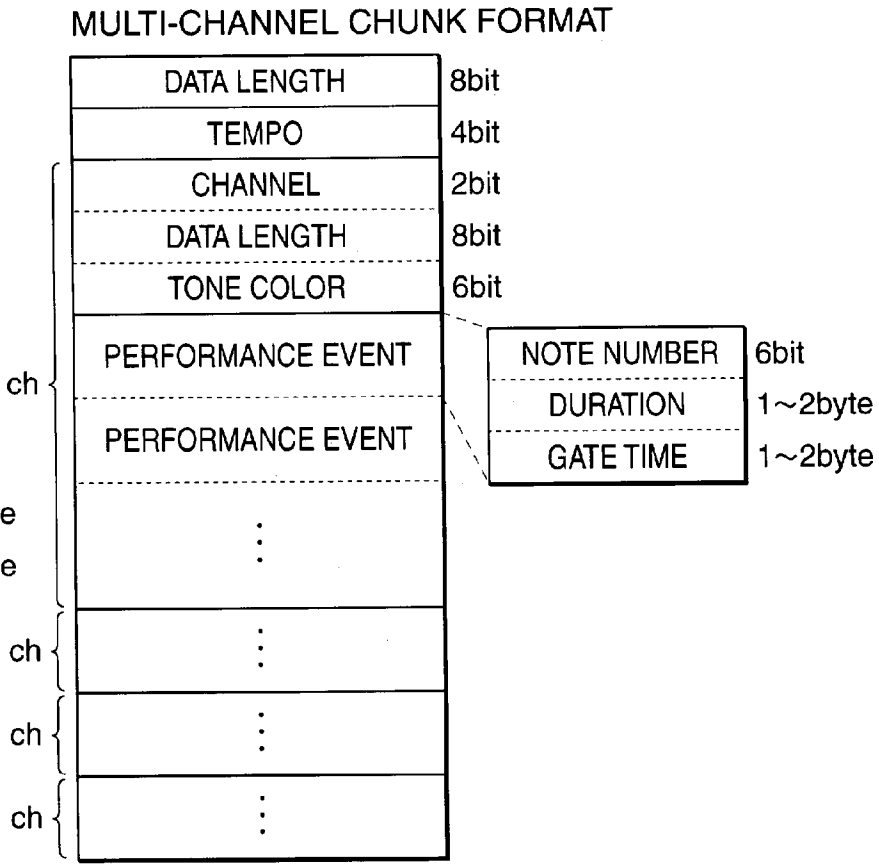

FIGS. 3A and 3B show two kinds of formats of music data to be compressed according to the present embodiment. FIGS. 3A and 3B each show a single file of music data for the same single music piece. In general, music data as shown in the figures is formed of data for a plurality of channels (16 channels in the case of the SMF) corresponding to respective parts. In the present embodiment, it is assumed that the music data is formed of data for four channels, and hence it is possible to generate musical tones having four tone colors at the maximum. Further, in the present embodiment, the music data is formed in one of the two kinds of channel formats, i.e. a single-channel chunk format and a multi-channel chunk format, which are different from each other in management of the channels.

In the single-channel chunk format, shown in FIG. 3A, the data of "data length", "tempo" and "tone colors" are recorded as a header, and "performance event" data (performance event information) corresponding to tones of a music piece are recorded after the header. The "data length" is 8-bit data indicative of the entire data length, the "tempo" is 4-bit data indicative of music-reproducing tempo, and each "tone color" is 6-bit data indicative of tone colors assigned respectively to the channels ch1 to ch4.

Each "performance event" data is comprised of data (note information) of "channel", "note number", "duration" and "gate time". The "channel" data is 2-bit data indicative of the channel number of a channel to which the performance event belongs, the "note number" data is 6-bit data indicative of a tone pitch, the "duration" data is 1 to 2-byte data indicative of a time interval from an immediately preceding event (i.e. a note length), and the "gate time" data is 1 to 2-byte data indicative of a sounding duration.

In the multi-channel chunk format, shown in FIG. 3B, the data of "data length" and "tempo" are recorded as a header, and four channel-specific sets (chunks) of data are recorded on a channel-by-channel basis for four channels after the header. The number of the channel-specific chunks can be smaller than four. Each chunk of data includes "channel" data indicative of the channel number of the chunk, "data length" data indicative of the entire data length of the chunk, and "tone color" data indicative of a tone color assigned to the chunk (channel), which are recorded as a header, and "performance event" data corresponding to respective tones of a music piece are recorded after the header.

Each "performance event" data is comprised of data of "note number", "duration", and "gate time", similarly to the FIG. 3A single-channel chunk format. However, in the case of the multi-channel chunk format, a channel number is set on a chunk-by-chunk basis, and hence each "performance event" data does not contain "channel" data. Each duration data represents a time interval from an immediately preceding event, and hence a duration corresponding to the first tone (performance event) of a whole music piece assumes a value of 0. On the other hand, duration data for the first tone(s) of the other channel(s) which is/are not the first one of the whole music piece assume(s) a value other than 0.

It should be noted that in either of the single-channel chunk format and the multi-channel chunk format, as shown in Table 1 below, each "note number" data is comprised of 2-bit "block" data indicative of an octave and 4-bit "note" data indicative of a pitch name.

TABLE 1

| Block (2 Bits) | Block Name | Note (4 Bits) | Pitch Name |
|---|---|---|---|
| 00b | Block 1 | 0000b | C |
| 01b | Block 2 | 0001b | C# |
| 10b | Block 3 | 0010b | D |
| 11b | Block 4 | 0011b | D# |
| | | 0100b | E |
| | | 0101b | F |
| | | 0110b | F# |
| | | 0111b | G |
| | | 1000b | G# |
| | | 1001b | A |
| | | 1010b | A# |
| | | 1011b | B |

Music data having the above format structure is processed by the distribution server 1 in the following manner: The distribution server 1 stores music data of various music pieces as sources recorded in the single-channel chunk format and the multi-channel chunk format. These music data are compressed and converted to compressed data in the single-channel chunk format and compressed data in the multi-channel chunk format. In the present embodiment, a note number included in each performance event is converted to data indicative of the difference from an initial note number, before the music data is compressed.

In the following, a description will be given of a first music data compression method according to the present embodiment.

First, the note number of the first performance event events of the same channel is detected and set to the initial note number (initial tone pitch). Then, the respective note numbers of the second and subsequent performance events of the same channel are each converted to a difference form indicative of the difference (pitch difference) from the initial note number. This conversion of note numbers to respective difference forms is performed on a channel (hereinafter also referred to as a "channel within the allowable note range") for which the differences of the note numbers of all the performance events can be represented by 5 bits, but the conversion is not performed on a channel for which at least one performance event having a note number whose difference from the initial note number cannot be represented by 5 bits. In this case, to discriminate the channel for which the conversion of note numbers to respective difference forms is not performed, it is only required to use a predetermined specific kind of data (other than the note number), in place of the initial note number of the channel. Then, the data of "duration" and "gate time" of each performance event are each rounded to one of predetermined note lengths appearing in Table 2, which is closest to that of the performance event, and converted to 3-bit data corresponding to the predetermined note length.

TABLE 2

| Duration/Gate Time (3 Bits) | Note Length |
|---|---|
| 000b | Whole Note |
| 001b | Half Note |
| 010b | Quarter Note |
| 011b | Eighth Note |
| 100b | Eighth Triplet |
| 101b | Sixteenth Note |
| 110b | Sixteenth Triplet |
| 111b | Thirty-Second Note |

Figure 2B:
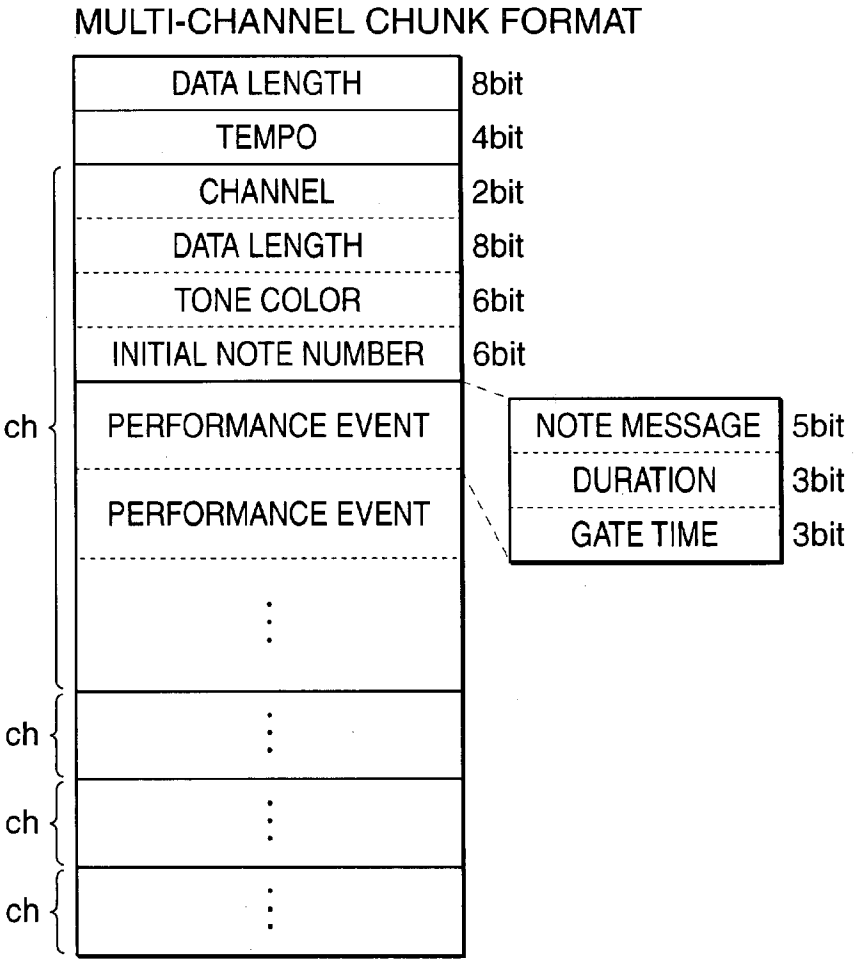
FIGS. 2A and 2B are diagrams each showing an example of a format of music data during compression by the music data compression method according to the embodiment.
Figure 2A:
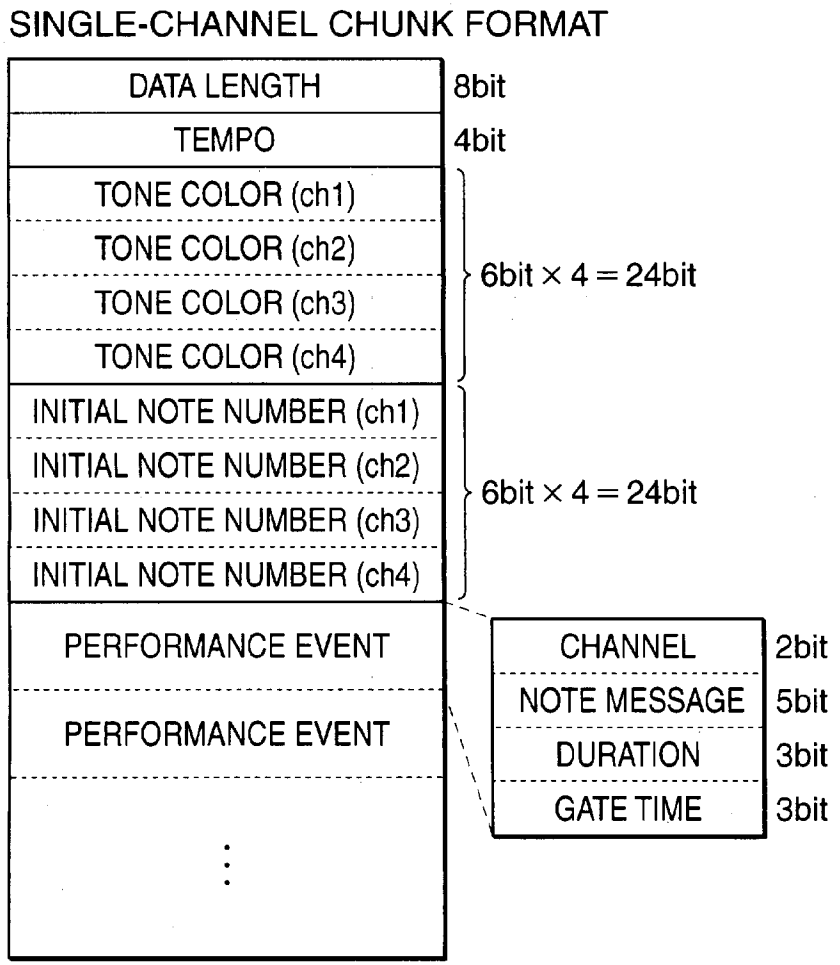

The above processing converts music data in the FIG. 3A and FIG. 3B formats to respective formats shown e.g. in FIGS. 2A and 2B. More specifically, in the single-channel chunk format of the compressed data, as shown in FIG. 2A, the note numbers of the respective first tones of the channels (ch1 to ch4) are added as "initial note numbers" to the header data. Each "performance event" data is comprised of 2-bit "channel" data, 5-bit "note message" data indicative of the difference of the note number of the performance event from the initial note number, 3-bit data of "duration", and 3-bit data of "gate time".

On the other hand, in the multi-channel chunk format of the compressed data, as shown in FIG. 2B, in the chunk of each channel, the note number of the first tone of the channel is added as an "initial note number" to the header data. Further, each "performance event" data is comprised of 5-bit "note message" data indicative of the difference of the note number from the initial note number, 3-bit data of "duration", and 3-bit data of "gate time". Needless to say, in the "performance event" data corresponding to the first tone, the "note message" data is recorded as "00000b" (meaning that the difference is 0).

Although in the above processing, the note number of the first performance event in each channel is set to the initial note number (initial tone pitch), this is not limitative but an arbitrary note number in each channel may be set to the initial note number. Alternatively, a note number additionally input and set may be used as the initial note number.

In the following, a description will be given of a second music data compression method of the present embodiment.

The second music data compression method is distinguished from the first music data compression method in which music data is compressed on a channel-by-channel basis, in that music data is compressed in terms of all the channels. More specifically, first, performance events for all the channels are checked, and the note number of the first performance event of all the channels is detected and set to an initial note number (initial tone pitch). Then, the note numbers of the performance events of each of the channels are each converted to a difference form indicative of the difference (pitch difference) from the initial note number. This conversion of note numbers to respective difference forms is performed only when the differences of the note numbers of all the performance events of all the channels can be each represented by 5 bits. Then, similarly to the first method, the data of "duration" and "gate time" of each performance event are each rounded to one of predetermined note lengths appearing in Table 2, which is closest to that of the performance event, and converted to 3-bit data corresponding to the predetermined note length.

Also in the second music data compression method, an arbitrary note number in all the channels may be set to the initial note number (initial tone pitch), or alternatively, a note number additionally input and set may be used as the initial note number.

By the above processing, in the single-channel chunk format, the "initial note number" for all the channels is added as header data, and similarly to the FIG. 2A format, data of each performance event is comprised of 2-bit "channel" data, 5-bit "note message" data indicative of the difference of the note number of the performance event from the initial note number, 3-bit data of "duration", and 3-bit data of "gate time".

Since note numbers are each converted to the difference from the initial note number as described above, each music data is compressed compared with the case in which pitches are expressed by absolute values (note numbers) over the entire note range. Further, the data of "duration" and "gate time" are each expressed by a value rounded to a predetermined note length, which makes it possible to further compress the music data. Moreover, when the single-channel chunk format is converted to the multi-channel chunk format, data of each performance event in the latter format does not necessitate "channel" data, which makes it possible to obtain compressed data.

In the present embodiment, various compression processes are executed as described above, and further, it is possible to compress music data even more significantly by carrying out compression processing in terms of the sequence of performance event data in the following manner: Data of two adjacent performance events are compared with each other to detect a match or a mismatch in each kind of data of the following performance event from the preceding performance event. Then, 3-bit "status" data corresponding to a pattern of the detected matching/mismatching is added to the following performance event data, so that only necessary data (mismatching data) is left on the following performance event data depending on the matching/mismatching pattern to thereby compress the performance event data.

It should be noted that in the single-channel chunk format, the sequence of performance event data in the entire file (i.e. the sequence of performance event data for all the channels) are processed, whereas in the multi-channel chunk format, the sequence of performance event data for each channel (each chunk) are processed on a channel-by-channel (chunk-by-chunk) basis. As described above, for a channel for which the difference of at least one note number from the initial note number cannot be expressed by 5 bits, the note numbers are not converted to difference forms, and the above compression processing is performed for a channel of this type, particularly in the single-channel chunk format, in a manner distinguished from the other channels. In this case, the comparison between adjacent performance event data are carried out for detection of a match or a mismatch between note numbers (blocks and notes) thereof.

Table 3 shows the status, matching/mismatching conditions, data following the status, and the total number of bits of performance event data corresponding to each status. It should be noted that this The example of Table 3 shows a case in which note numbers are each converted to the difference form.

TABLE 3

Single-Channel Chunk Format

| Status (3 Bites) | Condition | Following Data (Necessary Data) | Total Number of Bits |
|---|---|---|---|
| 000b | Matching with Immediately Preceding Event in B, C, D | A | 5 |
| 001b | Matching with Immediately Preceding Event in C, D | A, B | 10 |
| 010b | Matching with Immediately Preceding Event in A, B | C, D | 9 |
| 011b | Matching with Immediately Preceding Event in C | A, B, D | 13 |
| 100b | Matching with Immediately Preceding Event in B | A, C, D | 11 |
| 101b | Matching with Immediately Preceding Event in A | B, C, D | 14 |
| 110b | Different from Immediately Preceding Event in All | A, B, C, D | 16 |
| 111b | Tie/Slur Processing with Immediately Preceding Event | A, B, C, D | 16 |

A: Channel (2 Bites)
B: Note Message (5 Bits)
C: Duration (3 Bits)
D: Gate Time (3 Bits)

For instance, when a performance event is identical to an immediately preceding one in "note message", "duration", and "gate time" as exemplified in the uppermost row, only "channel" data is left after "status" data to form a compressed performance event. In this case, the total number of bits of the performance event is 5 bits obtained by adding 2 bits of the "channel" data to 3 bits of the "status" data. Similarly, in each of the second row and others, only necessary data (mismatching data) are left after "status" data to form a compressed performance event. As a result, each performance event is compressed to 16 bits at the maximum, and 5 bits at the minimum. It should be noted that conditions connected with each other by one or more commas, such as "B, C, D", which are shown in the condition column of the table, are "AND" conditions.

Table 4 shows the status, matching/mismatching conditions, data following the status, and the total number of bits of performance event data. The example of Table 4 also shows a case in which note numbers are converted to the difference form.

TABLE 4

Multi-Channel Chunk Format

| Status (3 Bites) | Condition | Following Data (Necessary Data) | Total Number of Bits |
|---|---|---|---|
| 000b | Matching with Immediately Preceding Event in B, C, D | — | 3 |
| 001b | Matching with Immediately Preceding Event in B, D | C | 6 |
| 010b | Matching with Immediately Preceding Event in C, D | B | 8 |
| 011b | Matching with Immediately Preceding Event in B | C, D | 9 |
| 100b | Matching with Immediately Preceding Event in C | B, D | 11 |
| 101b | Matching with Immediately Preceding Event in D | B, C | 11 |
| 110b | Different from Immediately Preceding Event in All | B, C, D | 14 |
| 111b | Tie/Slur Processing with Immediately Preceding Event | B, C, D | 14 |

B: Note Message (5 Bits)
C: Duration (3 Bits)
D: Gate Time (3 Bits)

Table 4 is similar to Table 3 in the meaning of each table element, and hence detailed description thereof is omitted. It will be learned from Table 4 that in the multi-channel chunk format, however, each performance event does not contain "channel" data, which makes the performance event data even shorter than in the single-channel chunk format.

Figure 1A:
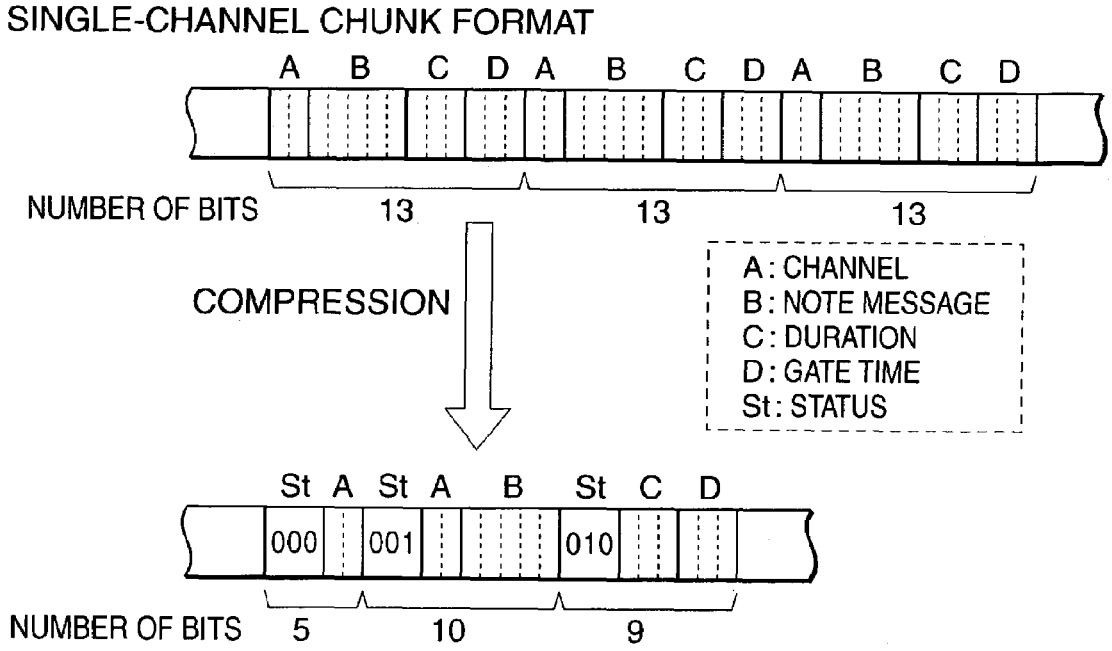
FIGS. 1A and 1B are diagrams each showing an example of music data before and after compression of a sequence of performance event data, carried out by a music data compression method according to an embodiment of the present invention.
Figure 1B:
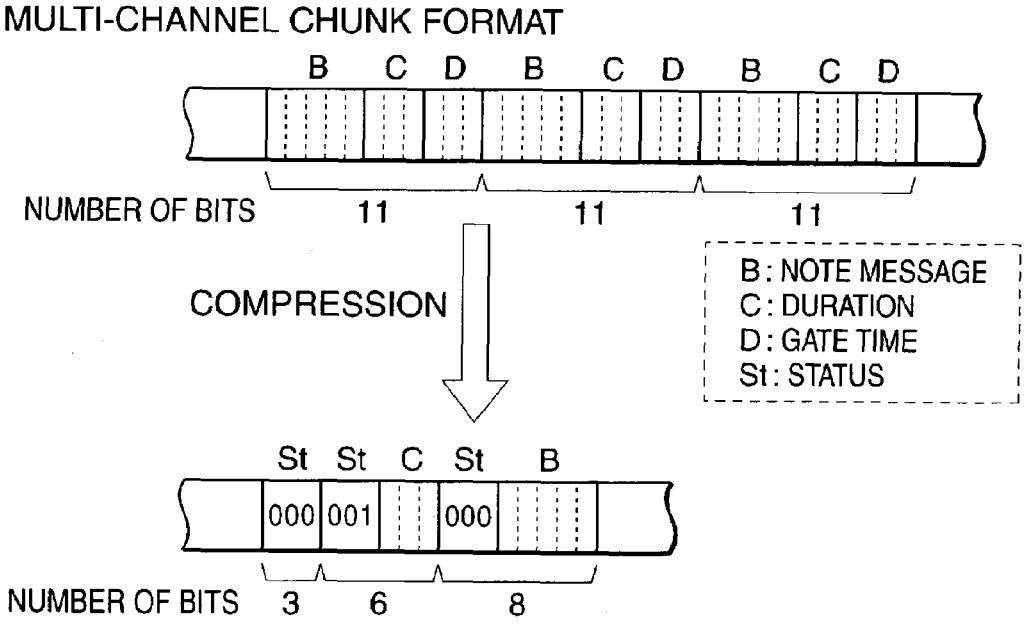

FIG. 1A and FIG. 1B each illustrate an example of music data before and after compression of a sequence of performance events carried out by the present embodiment. In the figures, "A" represents "channel " data, "B" "note message" data, "C" "duration" data, "D" "gate time" data, and "St" "status" data. In the single-channel chunk format shown in FIG. 1A, "channel" data, "note message" data, "duration" data, and "gate time" data constitute data of one performance event before compression, and the data of the performance event is 13 bits in total. If in a first performance event in FIG. 1A, its "status" data assumes "000" (corresponding to the uppermost row in Table 3) based on a condition (pattern) of matching or mismatching with the immediately preceding performance event, the performance event is represented only by the "status" data and the remaining "channel" data, and hence it is compressed to a 5-bit performance event. Further, a performance event with its "status" data assuming "001" is compressed to 10-bit data, while a performance event with its "status" data assuming "010" is compressed to 9-bit data.

On the other hand, in the multi-channel chunk format shown in FIG. 1B, "note message" data, "duration" data and "gate time" data constitute data of one performance event before compression, and the performance event is 11 bits in total. If in a first performance event in FIG. 1B, its "status" data assumes "000" (corresponding to the uppermost row in Table 4) based on a condition (pattern) of matching or mismatching with the immediately preceding performance event, the performance event is represented only by the "status" data, and hence it is compressed to a 3-bit performance event. Similarly, a performance event with its "status" data assuming "001" is compressed to 6-bit data, while a performance event with its "status" data assuming "010" is compressed to 8-bit data.

Figure 8:
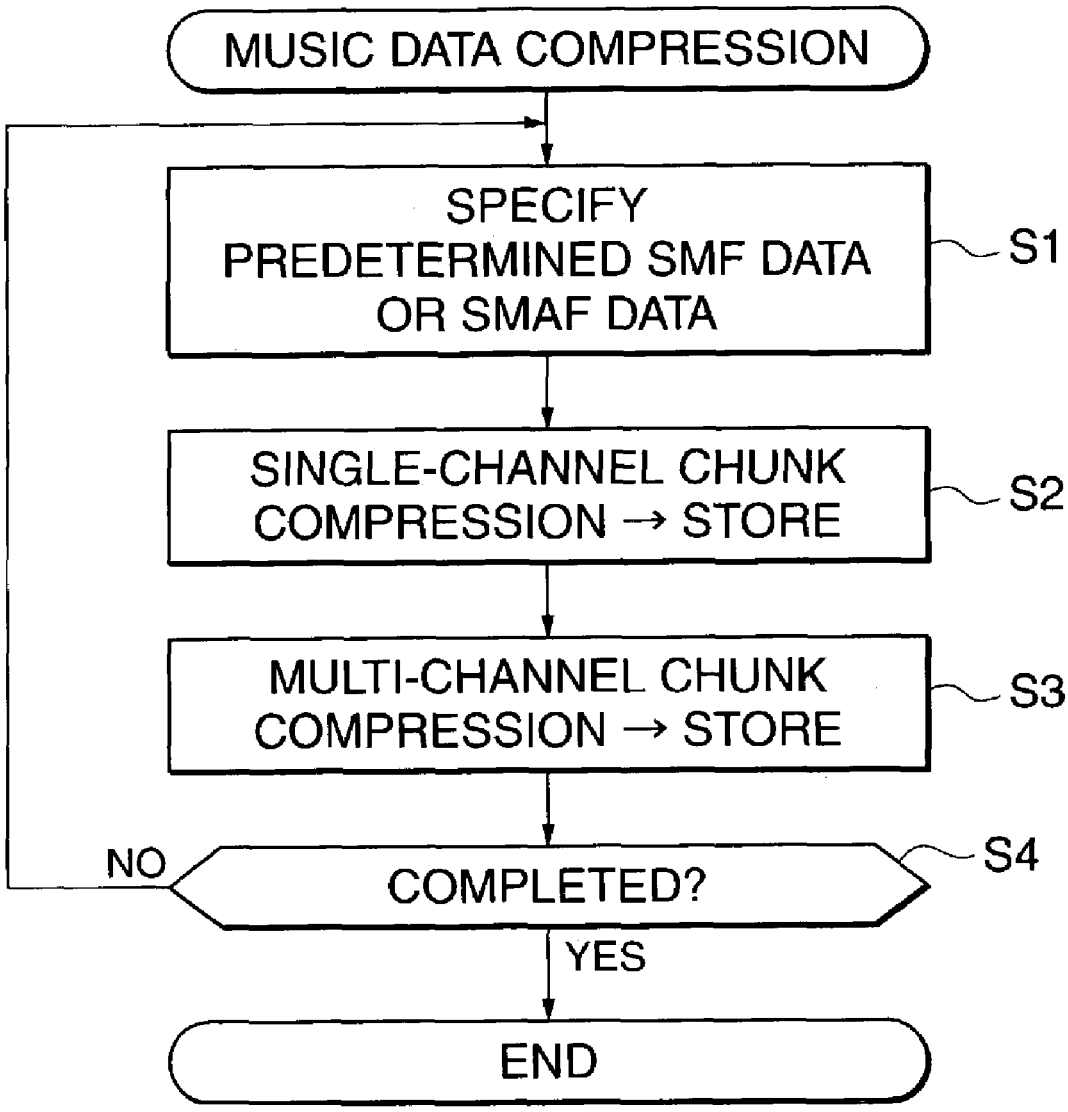
FIG. 8 is a flowchart showing an essential part of a music data compression process carried out by the distribution server appearing in FIG. 5.
Figure 9:
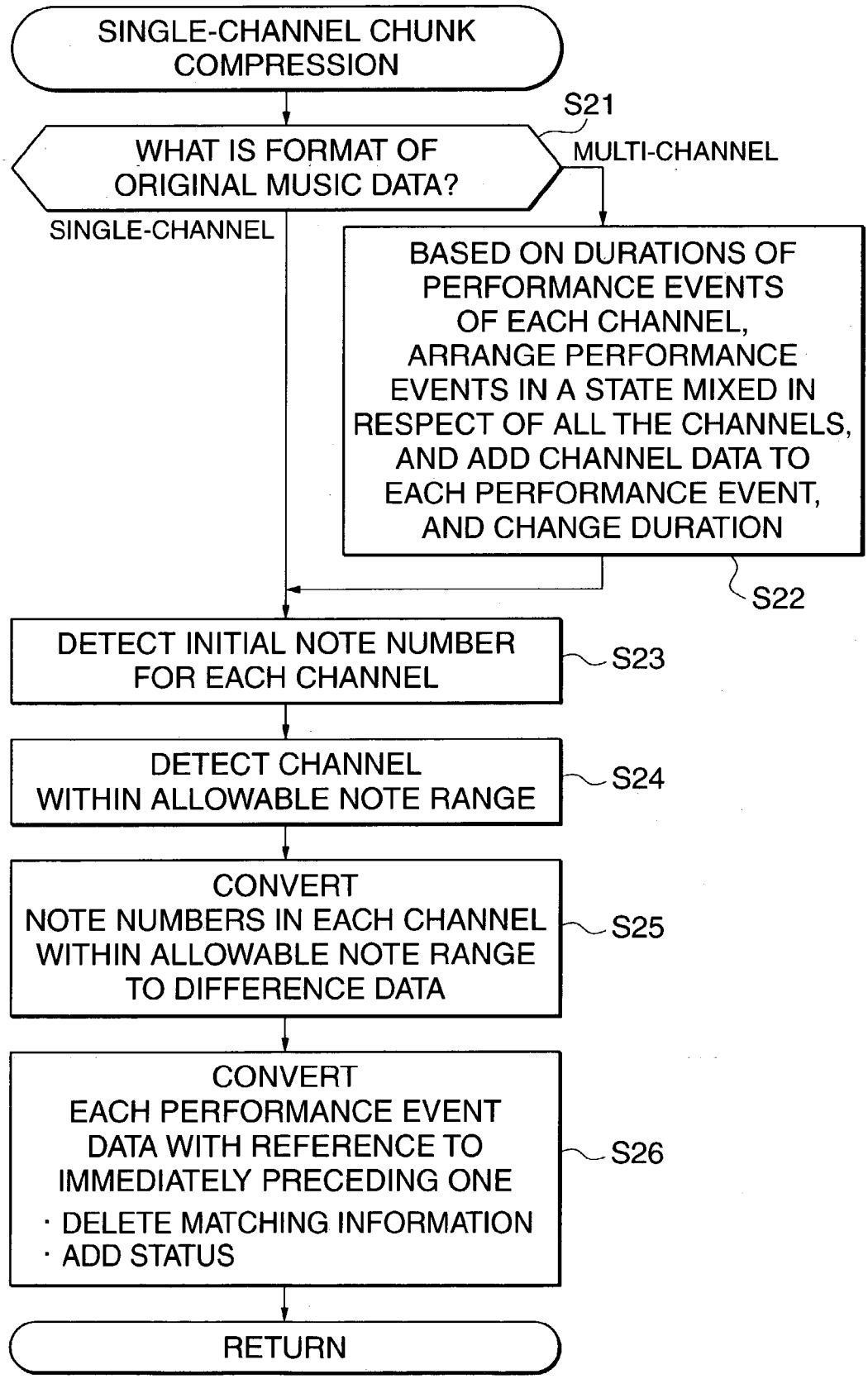
FIG. 9 is a flowchart showing a subroutine of a single-channel chunk compression process carried out by the music data compression method according to the embodiment.
Figure 10:
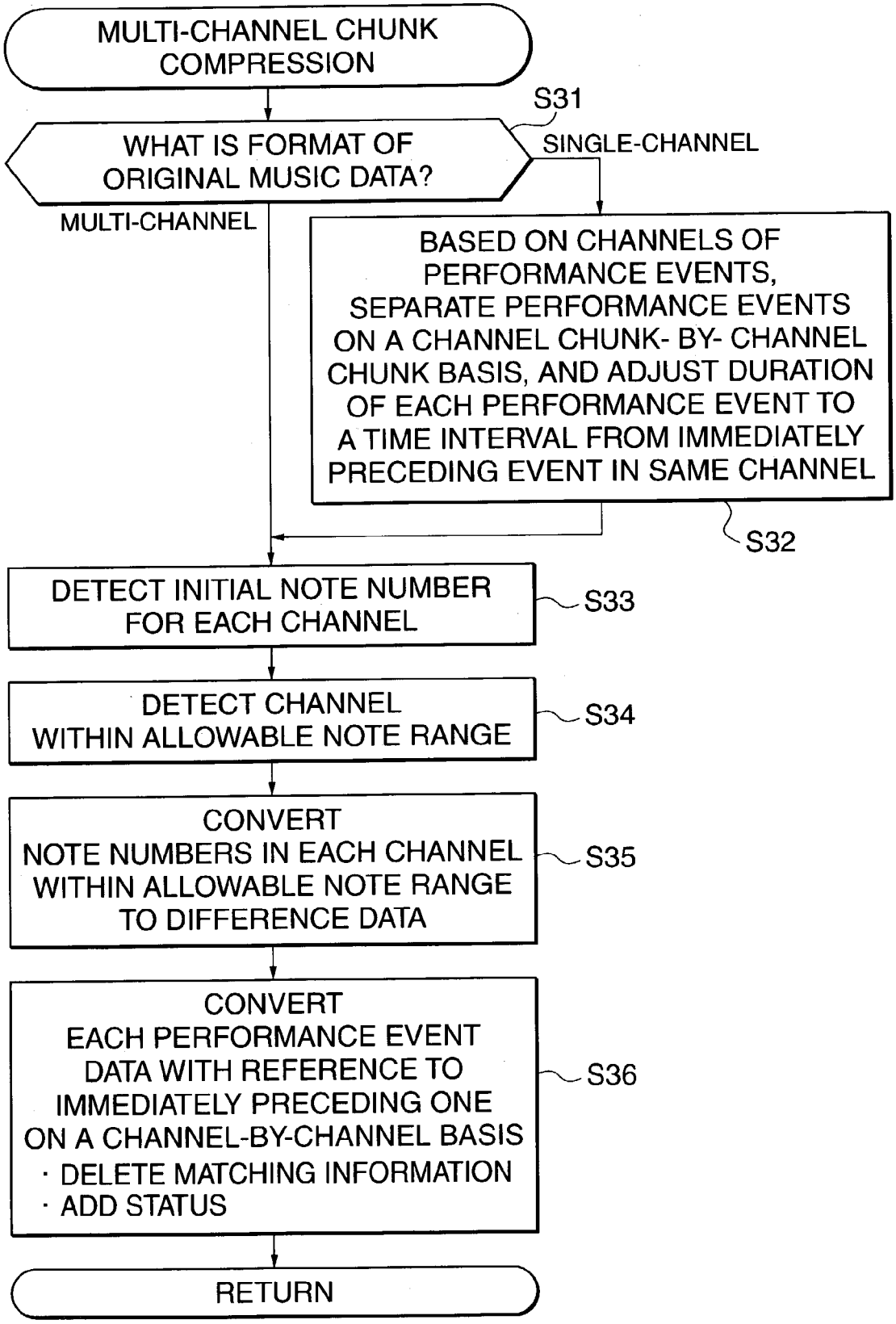
FIG. 10 is a flowchart showing a subroutine of a multi-channel chunk compression process carried out by the music data compression method according to the embodiment.
Figure 11:
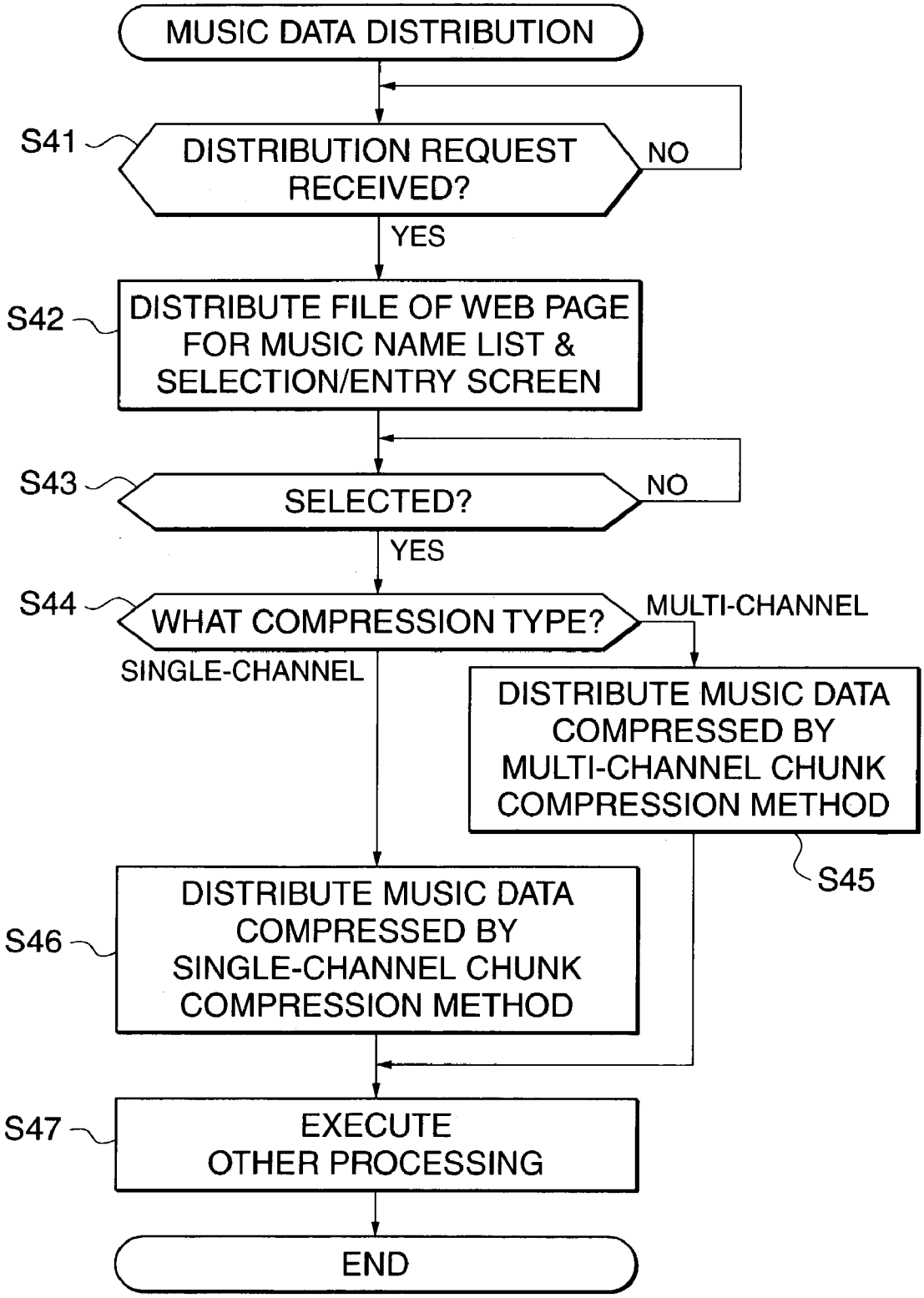
FIG. 11 is a flowchart showing an essential part of a music data distribution process carried out by the music data compression method according to the embodiment.

FIG. 8 is a flowchart showing an essential part of a music data compression process executed by the distribution server 1 shown in FIG. 5. FIG. 9 is a flowchart showing a subroutine for carrying out a single-channel chunk compression process, while FIG. 10 is a flowchart showing a subroutine for carrying out a multi-channel chunk compression process. Further, FIG. 11 is a flowchart showing an essential part of a music data distribution process. It should be noted that the processes shown in these flowcharts employ the first music data compression method. Referring first to FIG. 8, when the music data compression process is started, predetermined SMF or SMAF data is designated in a step S1, and in a step S2, the single-channel chunk compression process, shown in FIG. 9, is executed on the predetermined data to store the compressed data. Then, in a step S3, multi-channel chunk compression process, shown in FIG. 10, is performed on the predetermined data to store the compressed data. In the following step S4, it is determined whether or not the process has been completed, and if necessary, the above steps are repeatedly executed to store compressed music data in the external storage 1*b*.

In the single-channel chunk compression process shown in FIG. 9, the format of music data to be compressed is determined in a step S21. When it is determined in the step S21 that the music data is in the multi-channel chunk format, the process proceeds to a step S22, whereas if the music data is in the single-channel chunk format, the process proceeds to a step S23. In the step S22, the data for all the channels are focussed on, and based on the duration data of the performance events for all the channels, the performance events for all the channels are arranged in a time series order. Then, the channel number of a corresponding original channel is added to each performance event, and the durations of the performance events are changed so as to correspond to the intervals between the performance events resulting from the arranging of the data for all the channels. In short, the multi-channel chunk format is converted to the single-channel chunk format in the step S22. Then, the process proceeds to the step S23.

In the step S23, the initial note number for each channel is detected and stored, and in a step S24, it is detected, on a channel-by-channel basis, whether or not the difference of each note number from the corresponding initial note number can be expressed by 5 bits. In short, it is detected whether or not each channel is within the allowable note range. Then, in a step S25, the note numbers for each channel within the allowable note range are converted to data (note message) indicative of the differences from the corresponding initial note number and stored. Then, in a step S26, each performance event data is converted according to a corresponding one of the conditions in Table 3 through comparison of the performance event with the immediately preceding one. More specifically, if a performance event includes any data matching with that of the immediately preceding performance event, the data is deleted from the present performance event, and a status corresponding to a condition (matching/mismatching pattern) satisfied by the comparison between the two performance events is added, to thereby form one performance event. This processing is performed on all the performance events of the music data, and when the processing is completed for all the performance events, the process returns to the main routine shown in FIG. 8.

In the multi-channel chunk compression process, shown in FIG. 10, the format of music data to be compressed is determined in a step S31. When it is determined in the step S31 that the music data is in the single-channel chunk format, the process proceeds to a step S32, whereas if the music data is in the multi-channel chunk format, the process proceeds to a step S33. In the step S32, based on channel data included in the respective performance events, the performance events are classified into channel chunks each of which forms a group of the same channel, to thereby separate the data into groups of data for the respective channels. Then, the duration of each performance event is changed such that it becomes equal to the interval from the immediately preceding performance event for the same channel. In short, the single-channel chunk format is converted to the multi-channel chunk format in the step S32. Then, the process proceeds to the step S33.

In the step S33, the initial note number for each channel is detected and stored, and in a step S34, it is detected whether or not each channel is within the allowable note range. Then, in a step S35, the note numbers for each channel within the allowable note range are converted to data (note message) indicative of the differences from the corresponding initial note number and stored. Next, in a step S36, each performance event data for each channel is converted according to a corresponding one of the conditions in Table 4 through comparison of the performance event with the immediately preceding one. More specifically, if a performance event includes any data matching with that of the immediately preceding performance event, the data is deleted from the present performance event, and a status corresponding to a condition satisfied by the comparison between the two performance events is added, to thereby form one performance event. This processing is performed on all the performance events of the music data, and when the processing is completed for all the performance events, the process returns to the main routine shown in FIG. 8.

The music data distribution process shown in FIG. 11 is executed whenever the cellular phone 2 accesses the distribution server 1, for example, to receive services of distribution of various contents. First, it is determined (monitored) in a step S41 whether a request by the user (cellular phone 2) for distribution of an incoming call melody has been made. If a distribution request has been made, in a step S42, a file of a Web page for displaying a music name list of compressed music data stored in the external storage 1*b* and a selective entry screen are sent to the cellular phone 2. As a result, the music name list and the selective entry screen are displayed on the display of the cellular phone 2, thereby enabling the user to selectively enter the name of his/her desired music piece and a required compression type, i.e. one of the single-channel chunk compression and the multi-channel chunk compression, by using the cellular phone 2.

In this state, selective entry of the name of a music piece and a compression type is monitored in a step S43, and if the selective entry is made, the selected compression type is determined in a step S44. If the selected compression type is the multi-channel chunk compression, the music data of the selected music piece compressed by the multi-channel chunk compression method is distributed or sent in a step S45, followed by the process proceeding to a step S47. On the other hand, if the selected compression type is the single-channel chunk compression, the music data of the selected music piece compressed by the single-channel chunk compression method is distributed or sent in a step S46, followed by the process proceeding to the step S47. Then, other processing including a billing process is executed in the step S47, followed by terminating the distribution process.

Although in the single-channel chunk compression process shown in FIG. 9, in a manner conforming to the first music data compression method, the initial note numbers are used for the respective channels, this is not limitative, but a single note number, such as a note number arbitrarily selected from all the channels, a predetermined note number, an externally set note number, or an average note number between the highest tone pitch and the lowest tone pitch over all the channels, may be set to an initial note number (initial tone pitch) commonly used for all the channels. Further, although in the FIG. 10 multi-channel chunk compression process as well, the initial note numbers are used in the respective channels, this is not limitative, but any single initial note number may be used as described above.

When the compressed music data is distributed to the cellular phone 2 as described above, the music data is stored in the RAM 2*c* of the cellular phone 2. In the cellular phone 2, when an operation for confirming the incoming call melody is performed or when an incoming call occurs in a normal mode, the music piece is reproduced from the music data. To reproduce the music piece while reading the performance events of the music data from the RAM 2*c*, the CPU 2*a* executes the following processing:

When musical tones are reproduced from music data compressed by the single-channel chunk compression method, "tone color" data for the respective channels ch1 to ch4 are read out and set to the tone generator of the music reproducing section 2*g*, and then "initial note numbers" for the respective channels are read out. Then, a first performance event formed of data of "channel", "note message/note number", "duration" and "gate time" is read out. Then, the "note message" of the first performance event data is added to the "initial note number" for a channel corresponding to the "channel" data included in the first performance event, and the data obtained by the addition is delivered as "note number" data to the music reproducing section 2*g*, together with the data of "channel", "duration", and "gate time". It should be noted that if the channel for the performance event is not within the allowable note range, the performance event data is delivered as it is to the music reproducing section 2*g*.

Performance events after the first one are different in bit length, and hence the status data of each of the performance events is read out to discriminate or determine data forming the performance event. Then, each data deleted by compression processing is restored (expanded) to the same data as a corresponding one included in the immediately preceding performance event. Further, a "note message" is added to the "initial note number", whereafter the data of "channel", "note number", "duration", and "gate time" are delivered to the music reproducing section 2*g*. This processing is repeatedly carried out on performance events while sequentially reading out data thereof until a predetermined amount of data is written into the data buffer of the music reproducing section 2*g*.

When musical tones are reproduced from music data compressed by the multi-channel chunk compression method, four pointers corresponding to the respective channels ch1 to ch4 are set, whereafter "tone color" data are read out on a channel-by-channel basis and set to the tone generator of the music reproducing section 2*g*, and then "initial note numbers" for the respective channels are read out. Next, the respective pointers of the channels are updated, to sequentially read out performance events on a channel-by-channel basis. Similarly to the above processing for music data compressed by the single-channel chunk compression method, processing including restoration (expansion) of each of the performance events according to the status, and addition of the "note message" to the "initial note number" is executed, whereafter the data of "channel", "note number", "duration", and "gate time" are delivered to the music reproducing section 2*g*.

Since music data is distributed in a compressed state as described above, it is possible to reduce communication time and communication costs necessary for downloading the music data. Further, music data is expanded at the time of reproduction as described above, and hence the RAM 2*c* of the cellular phone 2 can be configured to have a small capacity for storing music data. Alternatively, compressed music data may be expanded (to its original size) before being stored in the RAM 2*c*. In this case, the RAM 2*c* is required to have somewhat larger storage capacity, but it is still possible to reduce communication time and communication costs required for downloading music data. Since the processing for expansion and reproduction is executed by a program stored in the ROM 2*b*, the program may be configured such that a user can select whether music data should be expanded before reproduction or sequentially expanded during reproduction.

Further, musical tones of music data may be reproduced while the music data is being downloaded. In this case, if the music data is compressed by the single-channel chunk compression method, expansion/reproduction can be started almost simultaneously upon receipt of a first performance event, thus being suitable for stream reproduction. It should be noted that music data compressed by the multi-channel chunk compression method can be only reproduced after performance events for the last channel start to be received.

In the above described embodiment, since the tone pitch is expressed by the difference from the initial note number, it is possible to reduce the size of data. However, just as in the case of a channel where the difference from the initial note number cannot be expressed by 5 bits, the compression of the data in terms of the sequence of performance events may be carried out with the note numbers remaining unprocessed. Further, the configuration of the note number and the number of channels are not limited to those of the above embodiment by way of example, but they can be set freely.

Although in the above embodiment, the program for expansion processing is stored in the ROM 2*b* of the cellular phone 2, this is not limitative, but the program may be distributed from the distribution server 1 to the cellular phone 2.

Although in the above embodiment, music data of an incoming call melody is distributed to the cellular phone 2, the present invention can be applied to a case where music data is distributed to the personal computer 4 compatible with a network, as shown in FIG. 5. In this case, the music data can be used e.g. for automatic performance by the personal computer 4 or by the electronic musical instrument 5. Further, the present invention can also be applied to distribution of karaoke music data to a karaoke apparatus or to distribution of music data for use in game software to a game machine.

Although in the above embodiment, the SMAF format is employed, the present invention is applicable to any music data including a sequence of performance events formed of note information. Therefore, needless to say, the present invention can be applied to music data in the general SMF format.

The present invention may either be applied to a system composed of a plurality of apparatuses or to a single apparatus. It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the above-described embodiment, and hence the storage medium on which the program code is stored constitutes the present invention. The storage medium for supplying the program code to the system or apparatus may be in the form of a floppy disk, a hard disk, an optical disk, an magneto-optical disk, a CD-ROM, a CD-R, a CD-RW, a DVD-ROM, a DVD-RAM, a DVD-RW, a DVD+RW, a magnetic tape, a nonvolatile memory card, or a ROM, for instance. Downloading via a network can also be utilized.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. A music data compression method comprising the steps of:

receiving music data including a sequence of pieces of performance event information each formed of note information including a plurality of types of parameters; and converting each of the pieces of performance event information of the music data to another form of performance event information including status information corresponding to a matching or mismatching pattern in note information between a piece of performance event information and an immediately preceding one of the pieces of performance event information, and at least one mismatching parameter, if any among the plurality of types of parameters included in the note information of the performance event information concerned, said at least one mismatching parameter each having a value thereof mismatching with that of a corresponding parameter included in the note information of the immediately preceding performance event information, wherein said another form of performance event information does not include any matching parameter among the plurality of types of parameters included in the note information of the performance event information concerned, said matching parameter each having a value thereof matching with that of a corresponding parameter included in the note information of the immediately preceding performance event information, and wherein the status information of said another form of performance event information is selected from a plurality of pieces of status information respectively provided in advance for a plurality of types of matching or mismatching patterns of a plurality of types of parameters included in the note information between performance event information and the immediately preceding performance event information.

2. A music data compression method according to claim 1, wherein the note information includes a tone pitch parameter, and wherein said converting step includes representing the tone pitch parameter included in the note information by a difference from a predetermined initial tone pitch.

3. A music data compression method according to claim 2, wherein the initial tone pitch is tone pitch of any one of the pieces of performance event information included in the music data.

4. A music data compression method according to claim 2, wherein the music data received in said receiving step comprises a sequence of pieces of performance event information for a plurality of channels, and wherein said conversion step includes arranging the pieces of performance event information for all the plurality of channels in a time series order, and detecting a match or a mismatch in note information between each of the pieces of performance event information arranged for all the plurality of channels in a time series order and an immediately preceding one of the pieces of performance event information.

5. A music data compression method according to claim 4, wherein the initial tone pitch is set for each of the plurality of channels, and the tone pitch parameter is represented by the difference for each of the plurality of channels.

6. A music data compression method according to claim 4, wherein the initial tone pitch comprises a single tone pitch, and the tone pitch parameter of each of the pieces of performance event information for all the plurality of channels arranged in a time series order is represented by the difference from the single initial tone pitch.

7. A music data compression method according to claim 2, wherein the music data received in said receiving step comprises a sequence of pieces of performance event information for a plurality of channels, and wherein the converting step includes arranging the pieces of performance event information in a time series order on a channel-by-channel basis, and detecting a match or a mismatch in note information between each of the pieces of performance event information arranged in a time series order on a channel-by-channel basis and an immediately preceding one of the pieces of performance event information.

8. A music data compression method according to claim 1, wherein the note information of each of the pieces of performance event information contains a duration parameter indicative of an interval from an immediately preceding one of the pieces of performance event information, wherein when the duration parameter among the plurality of parameters of the performance event information mismatches with that of the immediately preceding performance event information, the duration parameter in the performance event information is converted into a predetermined note length data selected from a plurality of pieces of note length data that are provided in advance to have a common constant bit length and represent different note lengths, and wherein the predetermined note length data is made to be included in said another form of performance event information.

9. A music data compression method according to claim 1, wherein the note information of each of the pieces of performance event information contains a gate time parameter indicative of a sounding duration of a performance event corresponding to the performance event information, and wherein when the gate time parameter among the plurality of parameters of the performance event information mismatches with that of the immediately preceding performance event information, the gate time parameter in the performance event information is converted into a predetermined note length data selected from a plurality of pieces of note length data that are provided in advance to have a common constant bit length and represent different note lengths, and wherein the predetermined note length data is made to be included in said another form of performance event information.

10. A computer-readable storage medium storing a program for causing a computer to execute a music data compression method, the program comprising:

a receiving module for receiving music data including a sequence of pieces of performance event information each formed of note information including a plurality of types of parameters; and a conversion module for converting each of the pieces of performance event information of the music data to another form of performance event information including status information corresponding to a matching or mismatching pattern in note information between a performance event information and an immediately preceding one of the pieces of performance event information, and at least one mismatching parameter, if any among the plurality of types of parameters included in the note information of the performance event information concerned, said at least one mismatching parameter each having a value thereof mismatching with that of a corresponding parameter included in the note information of the immediately preceding performance event information, wherein said another form of performance event information does not include any matching parameter among the plurality of types of parameters included in the note information of the performance event information concerned, said matching parameter each having a value thereof matching with that of a corresponding parameter included in the note information of the immediately preceding performance event information, and wherein the status information of said another form of performance event information is selected from a plurality of pieces of status information respectively provided in advance for a plurality of types of matching or mismatching patterns of a plurality of types of parameters included in the note information between performance event information and the immediately preceding performance event information.

* * * * *